United States Patent [19]

Branston

[11] 4,419,605

[45] Dec. 6, 1983

[54] GAS DISCHARGE DISPLAY DEVICE

[75] Inventor: David Branston, Erlangen, Fed. Rep. of Germany

[73] Assignee: Siemens Aktiengesellschaft, Munich, Fed. Rep. of Germany

[21] Appl. No.: 221,257

[22] Filed: Dec. 30, 1980

[30] Foreign Application Priority Data

Jan. 28, 1980 [DE] Fed. Rep. of Germany ..... 3002930

[51] Int. Cl.[3] ..... H01J 61/16

[52] U.S. Cl. ..... 313/485; 313/582; 313/643

[58] Field of Search ..... 313/226, 186, 484, 485, 313/582, 643

[56] References Cited

U.S. PATENT DOCUMENTS 2,051,601 8/1936 Hobart ..... 313/186 X
2,203,452 6/1940 Berghaus et al. ..... 313/186 X
2,728,004 12/1955 Victoreen et al. ..... 313/226
2,966,602 12/1960 Waymouth et al. ..... 313/226 X
3,925,697 12/1975 Fein et al. ..... 313/485 X
4,085,351 4/1978 Takahashi et al. ..... 313/226 X

FOREIGN PATENT DOCUMENTS 2246344 4/1973 Fed. Rep. of Germany .
2248375 10/1979 Fed. Rep. of Germany .

*Primary Examiner*—Eugene R. La Rochel
*Attorney, Agent, or Firm*—Kenyon & Kenyon

[57] ABSTRACT

In a gas discharge display device with a gas discharge space which is separated by a hole matrix from an electron acceleration space, helium, to which an amount of 0.1 to 10% of at least one of the gases argon, crypton, xenon, nitrogen or carbon dioxide is admixed, is used as the filling gas with an overall pressure of 0.5 to 5 mbar to obtain an enhanced contrast effect on the picture screen.

1 Claim, 2 Drawing Figures

GAS DISCHARGE DISPLAY DEVICE

BACKGROUND OF THE INVENTION

This invention relates to gas discharge display devices in general and more particularly, to a gas discharge display device with a gas discharge space which is separated, by a hole matrix with control electrodes arranged in rows and columns, from an electron acceleration space which is terminated by a picture screen.

One known gas discharge display device shown in FIG. 1 contains within an envelope 11 a matrix of gas discharge cells. Associated with the cells are auxiliary anodes 13 arranged in rows and control electrodes 15 arranged in columns. The gas discharge takes place in a gas discharge space 16 between a cathode 17 and the auxiliary anodes. The electrons are accelerated between the control electrodes 15 and the anode 19 in an electron acceleration space 21 by an applied high voltage. A hole matrix formed by a sheet 23 of insulating material divides the common discharge path into an auxiliary discharge space 16 of relatively great length for operation with low voltage for the gas discharge current, and a second space 21 of short path length and high field strength for accelerating the electrons. The hole matrix consisting of insulating material 23 is used as a carrier for the auxiliary anode associated with the rows of the matrix. The control electrodes, which are used for brightness control, are arranged on the opposite flat side of the matrix. The electrons, which are generated in the auxiliary glow discharge with a row by row control and are moved toward the auxiliary anode, are controlled point by point in the subsequent discharge path of high field strength by the accordingly divided control electrode 15, are accelerated and imaged on a phospherous screen 25.

The energy of an electron in the glow discharge is between a few electron volts (eV) and the full operating voltage of the discharge, which in general is several hundred eV. The brightness is controlled by applying a negative voltage to the control electrode. All electrons with an energy higher than the control voltage can enter the high voltage space unimpeded and are accelerated there. The number of fast electrons becomes smaller, the fewer number of collisions taking place between electrons and gas molecules. Therefore, the distance between the auxiliary anodes and the negative glow, the kind of filling gas used and the gas pressure are the most important parameters which influence the energy distribution of the electrons. The number of collisions can be increased by adjusting the distance between the auxiliary anodes and the negative glow; the effectiveness of the collisions, however, depends essentially on the collision cross sections of the gas.

SUMMARY OF THE INVENTION

It is an object of the present invention to increase the contrast effect of the picture screen. Thus, as far as possible all electrons entering the acceleration space are to be utilized for the imaging effect and, at the same time, the dielectric strength in the acceleration space is not to be reduced appreciably.

While a high contrast ratio of over 100:1 is obtained with molecular gases such as hydrogen and nitrogen as the filling gas, these gases have only relatively little dielectric strength at the gas pressure prevailing in the acceleration space and the small electrode spacing. The accelerating voltage achievable with these gases and therefore also the peak brightness are accordingly limited. These gases are furthermore reactive and can therefore adversely affect the long-term stability of the discharge or the life of the phosphors used at the anode. While rare gases are not reactive, they too have in general a relatively low dielectric strength. Helium, on the other hand, has a high dielectric strength but small collision cross sections. With helium as the filling gas, a contrast ratio which does not appreciably exceed 10:1 is therefore obtained.

One known gas discharge display device contains a gas chamber which is disposed between a pair of opposing dielectric charge storage parts. Control electrodes are arranged in such a manner that their respective crossings form a discrete discharge space. The gas filling contains an ionized gas which consists, for instance, of neon or also of helium, the content of which is limited to 50% atom-%, in order to preclude an adverse effect on the brightness change. Helium is added to reduce the applied voltage which is required to maintain a fired gas discharge, and also for increasing the storage limit of the arrangement (DE-OS No. 2 246 344).

Another known gas discharge display panel uses a gas mixture, to which up to 0.5 atom-% xenon is added, as the ionizable filling gas. Up to 70 atom-% helium can be added as a buffer gas in order to reduce the firing voltage for the gas discharge (DE-AS No. 22 48 375).

It is an object of the present invention to achieve high dielectric strength by using a gas mixture as the ionizable filling gas for a device of the type mentioned at the outset with a gas discharge path which is separated from an electron acceleration path, and to obtain thereby high brightness and at the same time a good contrast ratio on the flat picture screen.

The invention is based on the discovery that Paschen's curve for helium is not appreciably decreased even when other rare or molecular gases up to 10% are added. Although the supplemental gas does not have much effect on the dielectric strength of the device, the energy distribution of the electrons in the glow discharge is heavily influenced by the addition. The invention therefore includes using helium, to which an amount of 0.1 to 10% of at least one of the gases argon Ar, xenon Xe, nitrogen $N_2$ or carbon dioxide $CO_2$ is admixed, with an overall pressure of 0.5 to 5 mbar, as a filling gas. With this gas composition, the gas discharge takes place in a region of the characteristic which adjoins the minimum of Paschen's curve to the left. In this region of the gas discharge, a good contrast behavior of the display device is obtained, with high dielectric strength.

DETAILED DESCRIPTION

Figure 1:
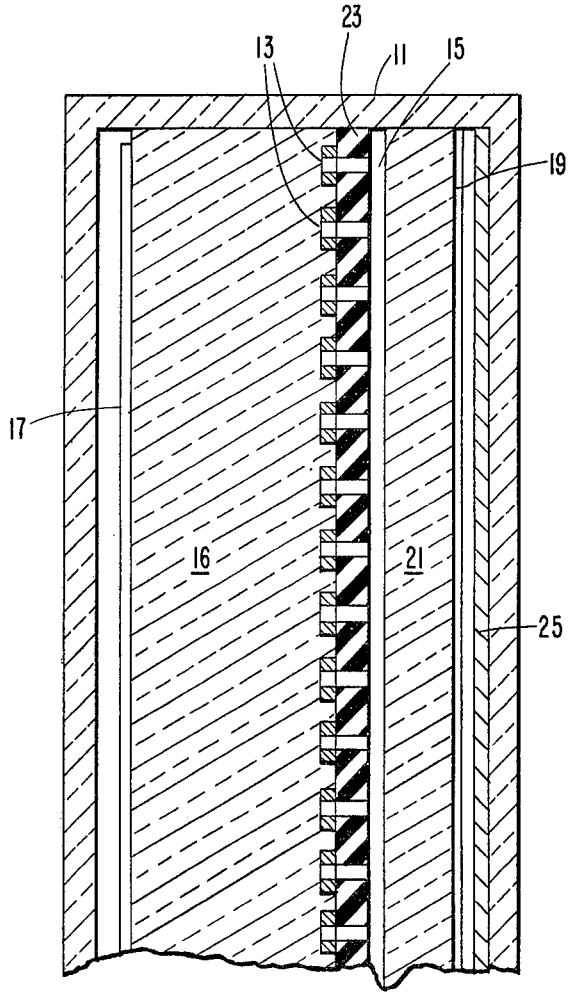
FIG. 1 PRIOR ART
FIG. 1 is a cross-sectional view through a known gas discharge display with which the improvement of the present invention may be used.
Figure 2:
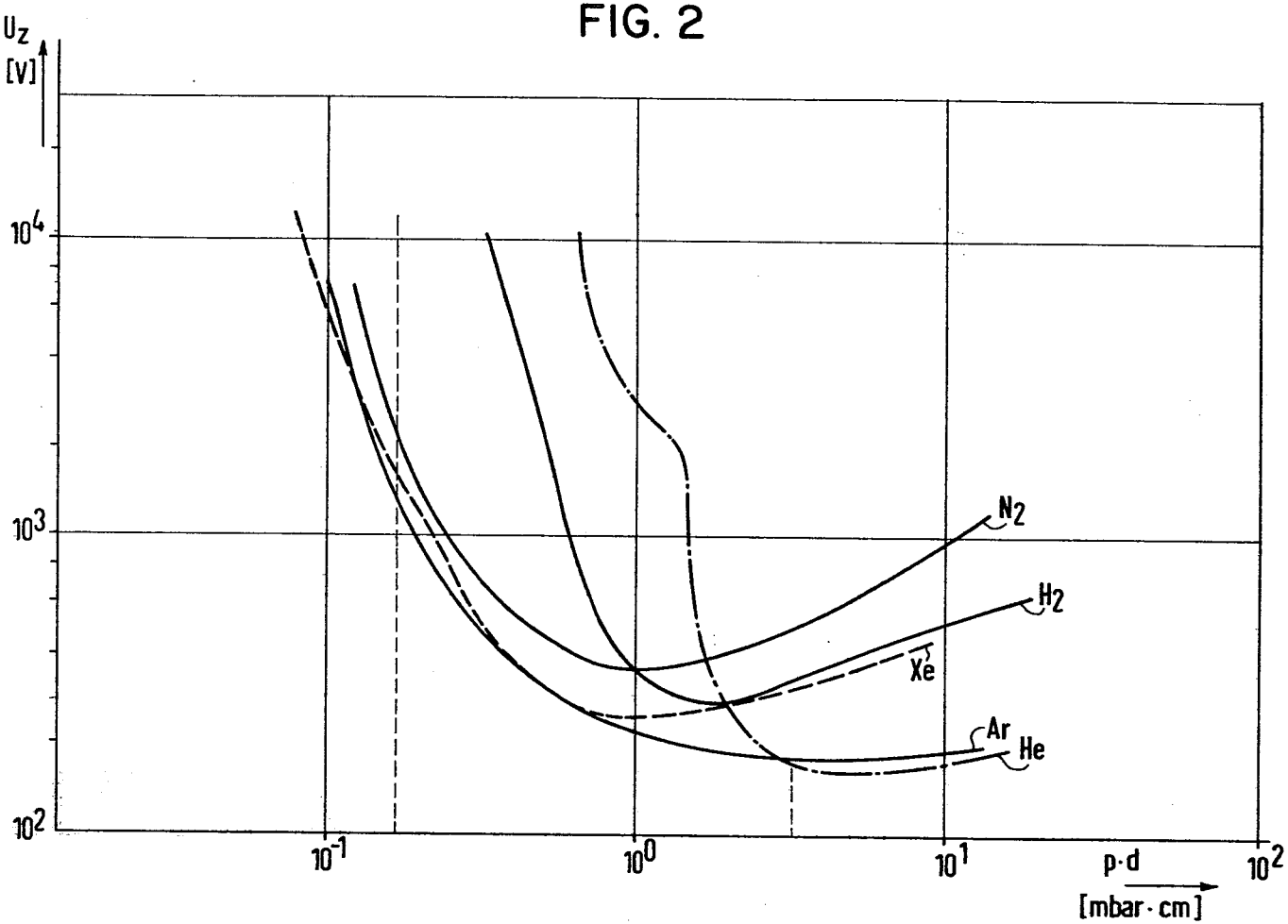
FIG. 2 is a series of curves in which the firing voltage for a glow discharge of different gases as a function of the product of gas pressure and electrode spacing is illustrated.

FIG. 2 shows Paschen's curves for helium He, hydrogen $H_2$, nitrogen $N_2$ and xenon Xe, as well as for argon Ar. It has been found that, for instance, with helium as the filling gas, an addition of up to about 3% by volume of another gas practically does not change the firing characteristic shown. If an amount of, for instance, 5% by volume argon Ar is added to the helium, a correspondingly low firing voltage is obtained at the minimum of the Paschen curve, at the glow discharge path with its relatively large electrode spacing of, say, 20 mm, and a product of gas pressure p and electrode spacing d of $3° \times 10°$. At the same time, at the electron acceleration path, with a small electrode spacing of, for instance, 1 mm and a $p \times d$ product of, for instance, $1.5 \times 10^{-1}$, a high firing voltage of substantially more than 10 kV and accordingly, a very high dielectric strength of the device is obtained. At the same time, the background brightness is substantially reduced by the amount of supplemental gas, and the contrast ratio is improved correspondingly.

What is claimed is:

1. In a gas discharge display device comprising a closed envelope containing a filling gas and having a gas discharge path which is separated, by a hole matrix with control electrodes, from an electron acceleration path which is terminated by a picture screen, the improvement comprising the filling gas being helium He, to which an amount of 0.1 to 10% by volume of at least one of the gases selected from the group consisting of argon Ar, kypton Kr, xenon Xe, nitrogen $N_2$ and carbon dioxide $CO_2$ is admixed, said filling gas being at an overall pressure of 0.5 to 5 mbar.

* * * * *